United States Patent [19]

Enemark

[11] 4,025,915

[45] May 24, 1977

[54] LED SMOKE DETECTOR CIRCUIT

[75] Inventor: Robert B. Enemark, Duxbury, Mass.

[73] Assignee: Electro Signal Lab, Inc., Rockland, Mass.

[22] Filed: Oct. 6, 1975

[21] Appl. No.: 619,629

[52] U.S. Cl. ..... 340/237 S; 250/574; 340/251

[51] Int. Cl.[2] ..... G08B 17/10

[58] Field of Search ..... 340/237 S, 251; 250/552, 574, 573, 565; 356/207

[56] References Cited

UNITED STATES PATENTS

| | | | |
|---|---|---|---|
| 3,316,410 | 4/1967 | Meili et al. | 340/237 S X |
| 3,534,351 | 10/1970 | Harnden, Jr. et al. | 340/237 S |
| 3,655,289 | 4/1972 | Walker | 356/207 X |
| 3,727,056 | 4/1973 | Enemark | 340/237 S X |
| 3,846,773 | 11/1974 | Lintelmann et al. | 340/237 S |
| 3,882,477 | 5/1975 | Mueller | 340/237 S |
| 3,922,655 | 11/1975 | Lecuyer | 340/237 S |
| 3,922,656 | 11/1975 | Horvath et al. | 340/237 S |

*Primary Examiner*—John W. Caldwell
*Assistant Examiner*—Daniel Myer
*Attorney, Agent, or Firm*—James H. Grover

[57] ABSTRACT

A simplified smoke or other particle detector circuit includes a light emitting diode in series with a compensating photocell and a photocell sensing LED light scattered from particles. In parallel with the LED is a high resistance, and in parallel with the photocells is a low resistance, the resistances having a common junction coupled to a threshold circuit input as is the output of the photocells. Sensing smoke produces a photocell output which triggers the threshold device to generate an alarm signal. Failure of the LED produces a voltage at the resistance junction which similarly triggers the threshold device to alarm.

6 Claims, 1 Drawing Figure

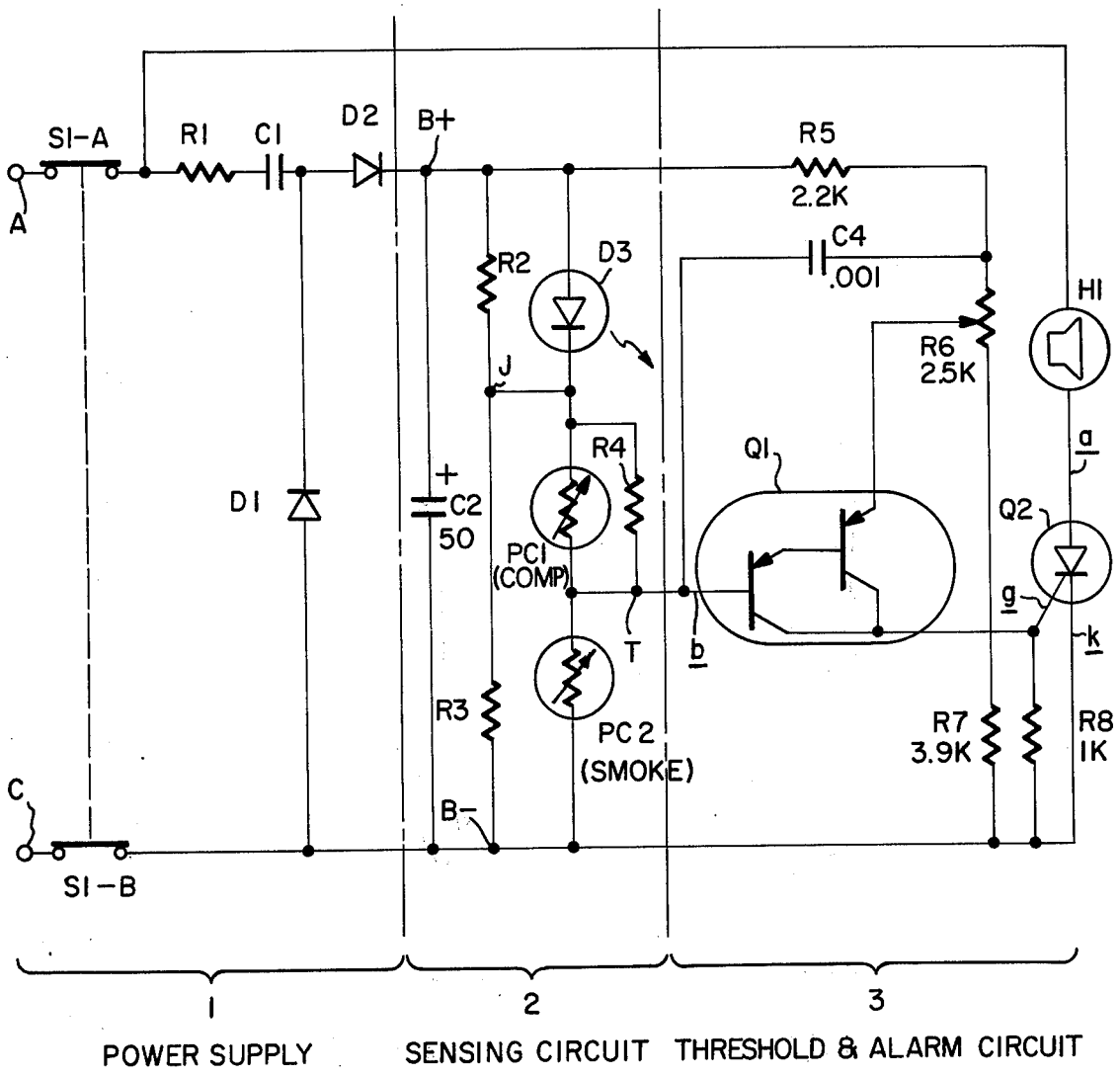
S1-A
R1
C1
D2
B+
R5
2.2K
A
C4
.001
R2
D3
H1
R6
2.5K
J
R4
Q1
a
D1
C2
50
PC1
(COMP)
Q2
g
T
b
k
R3
PC2
(SMOKE)
R7
3.9K
R8
1K
C
B-
S1-B
1
2
3
POWER SUPPLY
SENSING CIRCUIT
THRESHOLD & ALARM CIRCUIT

LED SMOKE DETECTOR CIRCUIT

BACKGROUND OF THE INVENTION

Reference is made to U.S. Pat. Nos. 3,774,186 and 3,863,076.

Typical particle detectors include an exciter lamp and a photocell normally shielded from direct lamp light and responsive to light scattered from smoke or other fluid borne particles in the light beam to trigger a threshold circuit which then produces an alarm signal actuating a horn or other local or remote alarm indicator.

When incandescent lamps are used as light sources they are shortlived and subject to unpredictably early failure rendering the detector inoperative, often unnoticed. It is therefore highly desirable to include in the detector a circuit for sensing lamp failure and giving an audible or visible alarm of the trouble condition. Incandescent lamps are more reliable and long lived if operated below their rated voltage, and light emitting diodes are substantially more reliable and are considered to have infinite life for practical purposes. But while the need for sensing and indicating lamp failure is greatly reduced it is still desirable to provide a trouble alarm as well as the primary alarm of smoke, for example.

Accordingly it is the object of the present invention to take advantage of the increased reliability and life of lamps, particularly LEDs, by providing a trouble or lamp failure alarm circuit which is greatly simplified and reduced to a low cost so that it can be more easily afforded.

STATEMENT OF INVENTION

According to the invention apparatus for detecting fluid borne particles comprises a power supply, a light source, photoelectric means responsive to source light scattered by particles to produce an alarm output, the light source, and photoelectric means being connected in series across the power supply, a threshold circuit having an input responsive to the alarm output to produce an alarm signal, a relatively high resistance in parallel with the light source, and a relatively low resistance in parallel with the photoelectric means, the resistances having a common junction coupled to the threshold device input such that failure of the light source produces a voltage at the junction causing the threshold device to produce an alarm signal.

DRAWING

FIG. 1 is a schematic diagram of a smoke detector circuit according to the invention.

DESCRIPTION

The low cost smoke detector of FIG. 1 generally consists of a power supply 1 converting 120 volt 60 hertz alternating current at terminals A and C to 15 volt direct current across terminals B+ and B−; a smoke sensing circuit 2 including an LED D3 (Fairchild FLV-252) and two photoelectric cells PC1 and PC2 (Clairex type 5M7M) having a common output terminal T which is also the input to a threshold and alarm circuit 3 which includes a Darlington emitter follower Q1 (Motorola MPSA65) and an SCR Q2 switching an AC horn H1.

In the power supply 1 ganged safety interlock switches are normally closed. Diodes D1 and D2 (IN4005 and IN4001, respectively) rectify the alternating current, the resulting direct current being smoothed by a resistor R1 (390 ohms) and capacitor C1 (25MFD). The sensing and threshold circuits are supplied with direct current whereas alternating current is impressed on the horn H1 and half wave rectified by the SCR Q2.

The sensing circuit is suitable for use in the smoke detector more fully shown in U.S. Pat. No. 3,863,076 wherein light from the LED D3 is directed into a dark chamber viewed by the smoke sensing cell PC2 and also falls directly on the compensating cell PC1 at low intensity, as explained more fully in U.S. Pat. No. 3,774,186. With no smoke in the chamber to scatter light to the smoke cell PC2, the smoke cell has a high resistance compared to the illuminated compensating cell PC1 and to the LED whose potential drop is about 2 volts. Consequently the voltage at the photocell junction T will be high, close to the B+ value. When smoke scatters light to the smoke cell PC2 its resistance drops and the voltage at junction T lowers to the trigger value of the input *b* to the Darlington threshold device Q1. The Darlington then applies an alarm signal to the gate *g* of the SCR Q2 allowing conduction on alternate half cycles through the SCR and horn H1, thereby audibly signalling an alarm or smoke condition.

The smoke detector circuit operation as so far described is similar to that described in U.S. Pat. No. 3,774,186. That patent provides in addition to the usual smoke alarm a trouble alarm which sounds different from the smoke alarm by means of an additional pulsing circuit and additional relay means coupling the smoke sensing circuit to the pulsing circuit. Despite the complexity and expense of the additional circuits of the patent they have continued to be used advantageously in smoke detectors having an LED light source and it has not been apparent that the trouble circuitry could be considerably simplified.

According to the present invention the LED D3 is connected in series with the two photocells PC1 and PC2 (or a single photocell if the compensating cell is omitted or replaced with another impedance), and a relatively high resistance R2 (820 ohms) and a relatively low resistance (R3 (560 ohms) are connected respectively in parallel with the LED or other light source and with the photoelectric means, the high and low resistances having a common junction J. The junction J is coupled by a resistor R4 (10 Megohms) to the input *b* of the Darlington threshold device Q1. In the trouble circuit described above it should be noted that the light source and photocells are not elements in addition to those necessary for smoke sensing.

The operation of the present trouble alarm circuit is as follows:

With the LED D3 conducting normally with a low potential drop the relatively high resistance R2 is effectively shunted or short circuited by the LED and the low resistance holds the resistor junction J at a high value, close to the B+ voltage. The junction voltage coupled to the Darlington input will thus be above its trigger value (about 7 volts) and the SCR Q2 will be in its non-conducting state. However, should the LED fail, typically by becoming an open circuit, it will not only cease to excite the compensating cell, but also cease to shunt the high resistance R2. The compensating cell PC1, and to a less extent the smoke cell PC2, will approach infinite resistance so that the voltage at the junction T and the threshold device input will follow the voltage at the resistor junction J. But resistor junction voltage is now determined by the voltage division of the no longer shunted high resistance R2 and the low resistance R3. The high resistance R2 will drop the junction J and Darlington input voltage toward the B− value below the threshold of the Darlington Q2. The Darlington threshold device will then close the SCR Q2 allowing the horn H1 to sound an alarm. While the trouble alarm so produced is not distinguishable from the smoke alarm, the reliability of the LED will insure that frequent false alarms do not occur. Such trouble alarms indicating the rare failure of the detector will be of high significance, justifying the full alarm while still affording simple, reliable and low cost trouble circuitry.

It should be understood that the present disclosure is for the purpose of illustration only and that this invention includes all modifications and equivalents which fall within the scope of the appended claims.

I claim:

1. Apparatus for detecting fluid borne particles comprising:

a power supply;

a light source;

photoelectric means responsive to source light scattered by particles to produce an alarm output, the light source, and photoelectric means being connected in series across the power supply;

a threshold circuit having an input responsive to the alarm output to produce an alarm signal;

a relatively high resistance in parallel with the light source; and a relatively low resistance in parallel with the photoelectric means, the resistances having a common junction coupled to the threshold device input such that failure of the light source produces a voltage at the junction causing the threshold device to produce an alarm signal.

2. Apparatus according to claim 1 wherein the light source is a solid state, electroluminescent device.

3. Apparatus according to claim 1 wherein the light source is a light emitting diode.

4. Apparatus according to claim 1 wherein the photoelectric means comprises two photoelectric devices in series having an output at their intermediate junction.

5. Apparatus according to claim 1 wherein the power supply comprises power terminals, the threshold device being responsive to a voltage approaching the voltage of one of the power terminals, and the low resistance being connected to said one power terminal.

6. Apparatus according to claim 5 wherein the high resistance is connected to the other power terminal.

* * * * *